US008074853B1

(12) United States Patent
Hirshberg

(10) Patent No.: US 8,074,853 B1
(45) Date of Patent: Dec. 13, 2011

(54) SPORTS BAG AND BACKPACK CONTAINING NYLON MESH POUCHES WITHIN THE BAG AND THE BACKPACK

(75) Inventor: Jonathan Hirshberg, Manhattan Beach, CA (US)

(73) Assignee: JR286 Technologies, Inc., Redondo Beach, CA (US)

( * ) Notice: Subject to any disclaimer, the term of this patent is extended or adjusted under 35 U.S.C. 154(b) by 1009 days.

(21) Appl. No.: 11/700,299

(22) Filed: Jan. 30, 2007

(51) Int. Cl.
*B65D 85/20* (2006.01)

(52) U.S. Cl. ..... 224/655; 224/652; 224/237; 206/315.1

(58) Field of Classification Search ..... 224/652–653, 224/656, 655, 237; 206/315.1; D3/221, D3/254; 190/112; 383/61.1, 61.3, 98
See application file for complete search history.

(56) References Cited

U.S. PATENT DOCUMENTS

| | | | | | |
|---|---|---|---|---|---|
| 3,115,959 | A * | 12/1963 | Jaffe | 206/287.1 |
| 4,063,581 | A * | 12/1977 | Williams | 206/315.1 |
| 4,739,913 | A * | 4/1988 | Moore | 224/643 |
| 5,431,265 | A * | 7/1995 | Yoo | 190/103 |
| D370,560 | S * | 6/1996 | Doerbaum | D3/254 |
| 5,588,529 | A * | 12/1996 | Speck | 206/315.1 |
| 6,193,034 | B1 * | 2/2001 | Fournier | 190/107 |
| 6,196,718 | B1 * | 3/2001 | DeChant | 383/66 |
| 6,561,329 | B2 * | 5/2003 | Stobbs et al. | 190/112 |
| 7,278,539 | B2 * | 10/2007 | Souza | 206/315.1 |
| 2002/0074199 | A1 * | 6/2002 | Albritton | 190/107 |
| 2002/0125285 | A1 * | 9/2002 | Parks et al. | 224/655 |
| 2004/0262178 | A1 * | 12/2004 | Speck | 206/315.1 |
| 2007/0034546 | A1 * | 2/2007 | Vosloo | 206/579 |
| 2007/0164070 | A1 * | 7/2007 | Bevier | 224/643 |

* cited by examiner

*Primary Examiner* — Justin Larson
*Assistant Examiner* — John Cogill
(74) *Attorney, Agent, or Firm* — Thomas I. Rozsa

(57) ABSTRACT

The present invention is a bag or backpack with the addition of at least one mesh pouch affixed within the bag. The at least one pouch is preferably made of mesh fabric, and includes a top opening with a top hem to contain fasteners which are placed inside of the hem. The top opening of the at least one pouch can be tightened together so that personal belongings which are placed inside of the at least one pouch will not drop out of the pouch. With the aid of the at least one interior pouch, the bag or backpack of the present invention significantly improves convenience, ease for organizing personal belongings being placed inside of the bag or backpack, and efficient use of the internal volume of the bag or backpack.

4 Claims, 8 Drawing Sheets

SPORTS BAG AND BACKPACK CONTAINING NYLON MESH POUCHES WITHIN THE BAG AND THE BACKPACK

BACKGROUND OF THE INVENTION

1. Field of the Invention

The present invention is related to sports bags, and more particularly to a bag containing interior nylon mesh pouches.

2. Description of the Prior Art

Bags are well known and enable people to store, carry and transport various types of personal belongings including sports equipment. A very popular type of bag is a duffel bag with a plain storage compartment having a zippered top. However, the bag with one plain compartment fails to effectively keep various items placed inside of the compartment in an organized fashion. There is a significant need to have a bag which provides a means to more efficiently store and organize items and especially sports items retained within the bag.

SUMMARY OF THE INVENTION

The present invention is related to a bag which includes the addition of pouches affixed into an interior compartment of the bag. In one preferred embodiment, two identical pouches are affixed in series onto an interior side of a bottom of the bag. Each of the pouches is comprised of a pouch body having a top opening, a right and left side end, and an enclosed bottom side. The top opening of the pouch includes a hem which further has a front and back drawstring, wherein a first end of the front and back drawstring is placed throughout an opening of the hem. Therefore, the top opening of the pouches can be closed through tightening the first end of the front and back string. In another preferred embodiment, at least one pouch is placed onto an interior side of the front or back side of the bag. The present invention addition of pouches within the bag provides a significantly improved and more convenient bag, and further provides a more efficient way to organize items being placed inside of the bag and increases the storage capacity of the bag.

It has been discovered, according to the present invention, that if two identical pouches are added in series onto a bottom interior side of a bag compartment, wherein each of the pouches has a top opening including a hem which includes a front and back drawstring, then the bag can be used by people to safely store items in the pouches in an organized fashion after closing the opening of each pouch by tightening the first end of each drawstring.

It has also been discovered, according to the present invention, that if at least one pouch is added onto a bottom interior side of a bag compartment, wherein at least one pouch has a top opening including a hem which has a front and back drawstring, wherein a first end of the front and back drawstring is placed throughout an opening of the hem, then the bag can be used by people to safely carry items in at least one pouch in an organized fashion after closing the opening of the at least one pouch.

It has been further discovered, according to the present invention, that if at least one pouch is added into an interior of a bag, wherein the at least one pouch has a top opening including fastener means, then the bag can be used by people to safely carry items in the at least one pouch.

It has also been discovered, according to the present invention, that if the at least one pouch is placed into the interior of a backpack, wherein the at least one pouch has a top opening including fastener means, then the backpack can be used by people to safely carry items in the at least one pouch.

It has additionally been discovered, according to the present invention, that if the at least one pouch is placed into an exterior compartment of a backpack, wherein the at least one pouch has a top opening including fastener means, then the backpack can be used by people to safely carry items in the at least one pouch.

It is an object of the present invention to provide two identical pouches which are added in series onto a bottom interior side of a bag compartment, wherein each of the pouches has a top opening including a hem which has a front and back drawstring, wherein a first end of the front and back drawstring is placed throughout an opening of the hem, so that the bag can be used by people to safely carry items in the pouches in an organized fashion after the pouches have been closed It is also an object of the present invention to provide at least one pouch which is added onto a bottom interior side of a bag compartment, wherein the at least one pouch has a top opening including a hem having a drawstring which enables the pouch to be closed.

It is an additional object of the present invention to provide at least one pouch which is added into an interior of a bag, wherein the at least one pouch has a top opening including the fastener means, so that the bag can be used by people to safely carry items in the at least one pouch in an organized fashion after closing the opening of the at least one pouch.

It is also an object of the present invention to provide at least one pouch which is placed into the interior of a backpack, wherein the at least one pouch has a top opening including fastener means, so that the backpack can be used by people to safely carry items in the at least one pouch.

It is an additional object of the present invention to provide at least one pouch which is placed into an exterior compartment of a backpack, wherein the at least one pouch has a top opening including fastener means, so that the backpack can be used by people to safely carry items in the at least one pouch.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

The present invention is a bag or backpack with the addition of at least one mesh pouch affixed within the bag or backpack. The at least one pouch is preferably made of mesh fabric, and comprises a top opening with a top hem to contain fasteners which are placed inside of the hem. Therefore, the top opening of the at least one pouch can be tightened together so that personal belongings which are placed inside of the at least one pouch will not drop out of the pouch while the bag or backpack is being carried. With the aid of the at least one interior pouch, the present invention bag or backpack provides a significantly more convenient way to organize personal belongings being placed inside of the bag or backpack, and provides significantly greater storage capacity within the bag or backpack.

Figure 1:
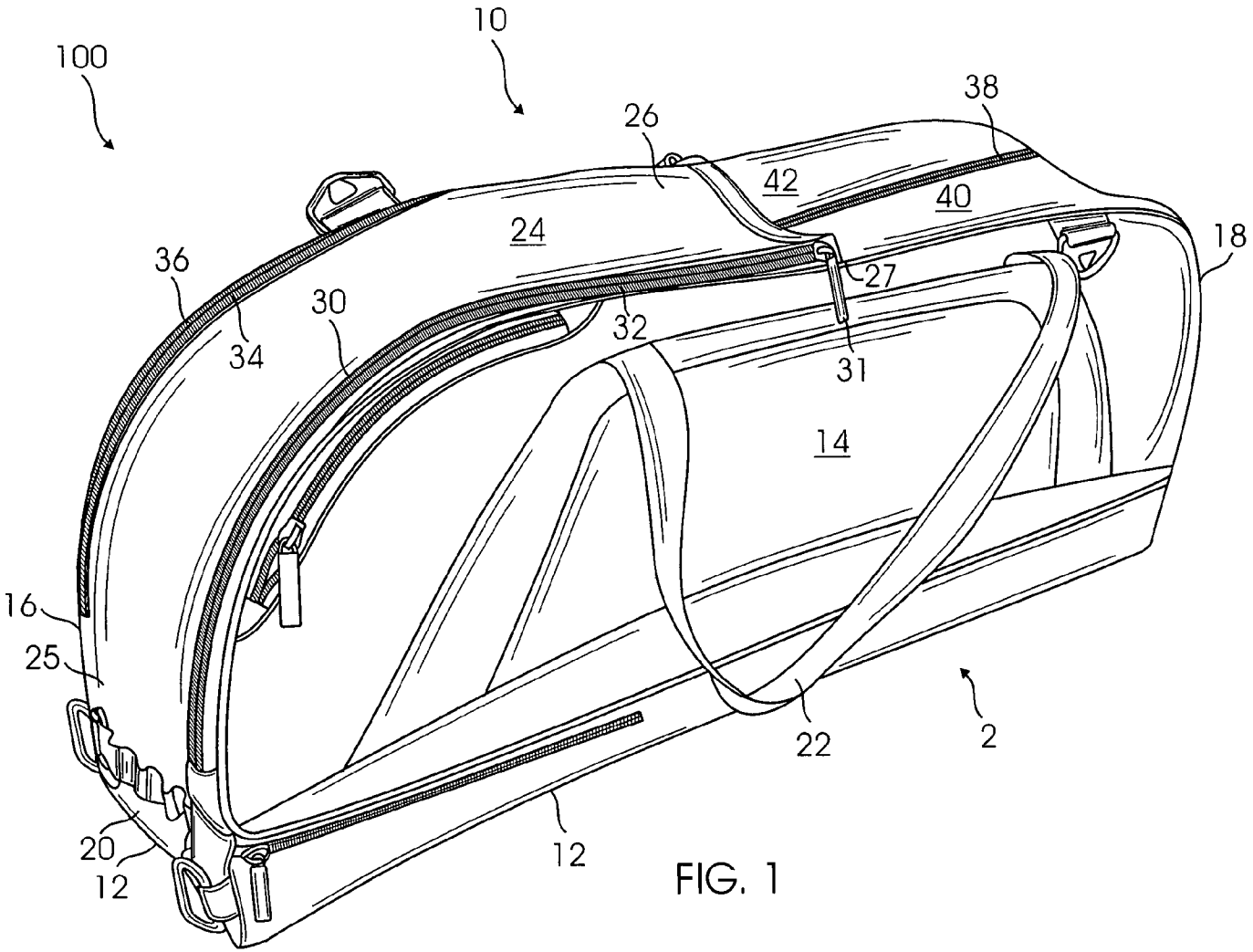
FIG. 1 is a perspective view of the bag of the present invention, wherein the top of the bag is zippered closed.
Figure 2:
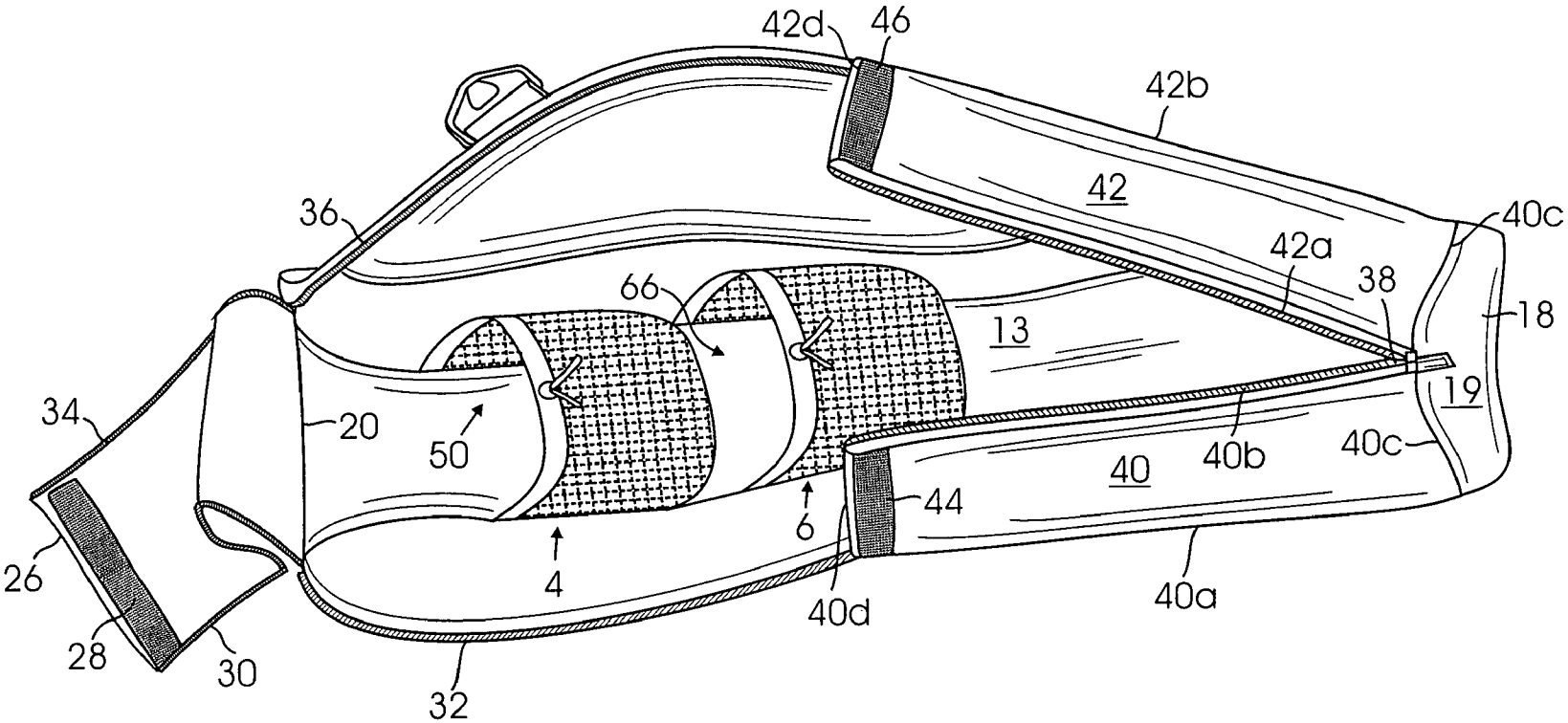
FIG. 2 is an interior top plan view of a preferred embodiment of the present invention bag with the addition of two mesh pouches, wherein the top of the bag is unzippered and the addition of the two mesh pouches is illustrated as being affixed in series onto an interior of the bottom of the bag.

Referring to the perspective view of FIGS. 1 and 2, there is illustrated bag 100 of the present invention, the bag 100 comprising an elongated body portion 2 having a top side 10 and a bottom side 12, a front side 14 and a back side 16, a left end 20 and a right end 18, and a right end side 19 of the bag body (see FIG. 3) to retain the right end 18 of the bag. A pair of the front and back side carrying straps, only one of which 22 is shown, is respectively affixed to the respective elongated front and back side 14 and 16 of the bag.

The top side 10 of the bag body 2 is comprised of a top elongated rectangular panel 24 and a pair of two short rectangular front and back panels 40 and 42. The top elongated panel 24, which can be swung backwards and forwards with respect to the left end 20 of the bag, is illustrated to have a lower end 25 which is affixed to the left end 20 of the bag and is remote from an upper fixed end 26 and is therefor free to move in a forward and backward swinging movement. The panel 24 is further comprised of a front elongated edge which is affixed to one set 30 of a front side zipper. Another set 32 of the zipper is affixed to a majority of the top edge of the front side 14 of the bag body 2, wherein the set 32 starts at a position close to the left end 20 of the bag and extends to a position 27 of the top edge of the bag front side 14. Referring to FIG. 1, the zipper having the sets 30 and 32 is zippered where a zipper handle 31 is placed at the position 27 on the top of the front side 14 of the bag. Similarly, a back elongated edge of the top panel 24 is affixed to one set 34 of a back side zipper and another set 36 of the back side zipper is affixed to a majority of the top edge of the back side 16 of the bag.

The right end 26 of the top panel 24 is illustrated in FIGS. 1 and 2 to cover part of the front and back panel 40 and 42. The paired panels 40 and 42 are symmetrically affixed to the right half of the top 10 of the bag body 2. The rectangular front panel 40 at its front elongated edge 40*a* is affixed to the top edge of the front side 14 of the bag 10, at its right edge 40*c* is connected to a top of the right end side 19 of the bag 10, and at its back elongated edge 40*b* is affixed a set of a middle zipper 38. The left end 40*d* of the front panel 40 is a free end but is attached with a hook and loop a fastener means 44. The rectangular back panel 42 at its back elongated edge 42*b* is affixed to the top edge 16*a* of the back side 16 of the bag 10, at its right edge 42*c* is connected to a top of the right end side 19 of the bag 10, and at its front elongated edge 42*a* is affixed to the middle zipper 38. The left end 42*d* of the back panel 42 is also a free end but is attached with a hook and loop a fastener means 46. It will be appreciated that a respective hook and loop fastener means 28 will be affixed on a back side of the top panel 24 close to the movable end 26, therefore, the top panel 24 can be securely closed after connection of the respective fastener means 28 at the right end of the top panel 24 to the fastener means 44 and 46 at the respective left end of the respective front and back panels 40 and 44, when the middle zipper 38 is closed.

FIG. 2 illustrates a condition in which the top panel 24 is swung backwards, and the middle zipper 38 is unzipped to separate the top front and back panels 40 and 42. Therefore, the internal structure of the bag is visible illustrating first and second identical pouches 4 and 6 which are the preferred embodiment of the present invention. The first and second pouches 4 and 6 are preferably made of a piece of nylon mesh material, and are affixed in series onto an interior surface 13 of the bottom 14 of the bag body 2, wherein the first pouch 4 is placed closer to the left end 20 of the bag, which is followed by the second pouch 6.

Figure 3:
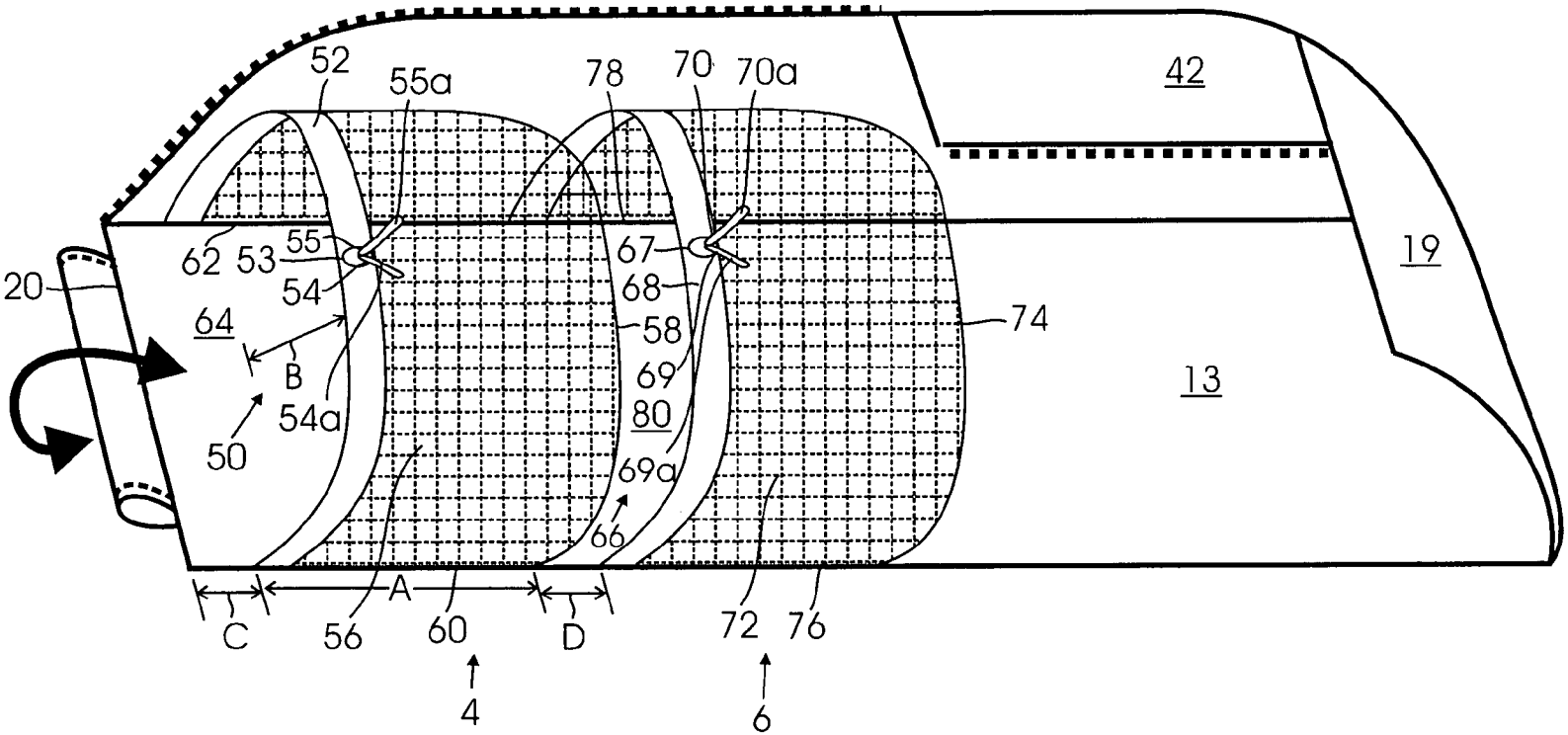
FIG. 3 is a cutaway view of the preferred embodiment of the present invention bag with the addition of the two mesh pouches, wherein the front side of the bag is removed so that the addition of the mesh pouches on the bottom of the bag is illustrated in detail.

Referring to the cutaway view of FIG. 3 wherein the front side 14 of the bag body is removed along with the top front panel 40, the first pouch 4 is illustrated to comprise a body 56 having an elastic top opening 50 which is towards the left end 20 of the bag, an enclosed bottom side 58, and a back side 64. Using the orientation of the opening 50 towards the left end 20 as a reference, the pouch body 56 at its left side end 60 is affixed through stitches to a front side edge of the interior surface 13 of the bottom 12 of the bag. Similarly, a right side end 62 of the pouch body 56 is affixed to the interior side 13 of the bag. It will be appreciated that the bottom side 58 of the pouch body 56 is also connected to the interior side 13 of the bottom of the bag. Therefore, connection of the right, left and bottom sides of the pouch body to the interior side 13 of the bag bottom defines the back side 64 of the pouch body 50, which is a part of the interior side 13 of the bottom of the bag. The connection also defines the elastic top opening 50 of the pouch 4 through which personal belongings can be placed into the pouch.

The top elastic opening 50 is comprised of a top hem 52 which further comprises front side and back side drawstrings 54 and 55. It will be appreciated that a second end of the front draw string 54 is affixed to the bottom interior side 13 of the bag through affixation of the left side end 60 of the pouch body 56 to the bottom interior side of the bag, while a first end 54*a* of the front draw string 54 is placed throughout an opening 53 at a middle of the hem 52. Similarly, a second end of the back drawstring 55 is affixed to the bottom 12 through affixation of the right side end 60 of the pouch body 50 to the bottom 12 of the bag, and a first end 55*a* is also placed throughout the opening 53 of the hem 52. Therefore, the top elastic opening 50 can be closed by tightening the first ends 54*a* and 55*a* of the respective front and back side drawstrings 54 and 55 to gather the elastic hem 50 together so that personal belongings placed inside of the pouch can be securely carried. It will be appreciated that it is within the spirit and scope of the present invention that the opening 53 does not have to be placed at the middle of the top hem 52. In addition, the front and back drawstrings 54 and 55 can be replaced with to a single string wherein a middle of the single string is placed throughout the opening 53 of the hem 52. Instead of the drawstrings, any type of fastening means can be utilized as long as the fastening means can securely close the top opening 50 of the pouch.

The second pouch 6 is structurally identical to the first pouch 4, comprising a body 72 having left and right side ends 76 and 78, a bottom side 74 and a top hem 68 of the body defining an elastic top opening 66 of the pouch. The top hem 68 further comprises front side and back side drawstrings 69 and 70, in which their respective first ends 69*a* and 70*a* are placed outside through an opening 67 of the hem 68 for fastening the top hem 68. It will be appreciated that specifications to affix the second pouch 6 to the interior side 13 of the bottom of the bag are similar to those for the first pouch 4.

In the preferred embodiment of the present invention, each pouch 4 and 6 has a depth "A" of seven and half inches for the body and a width "B" of twelve inches for the opening. In addition, the top opening 50 of the first pouch 4 is placed one inch away from the left end 20 of the bag body, and the top opening 66 of the second pouch 6 is four inches away from the bottom side 58 of the first pouch 4, which specified dimensions are respectively labeled "C" and "D" in FIG. 3.

Figure 4:
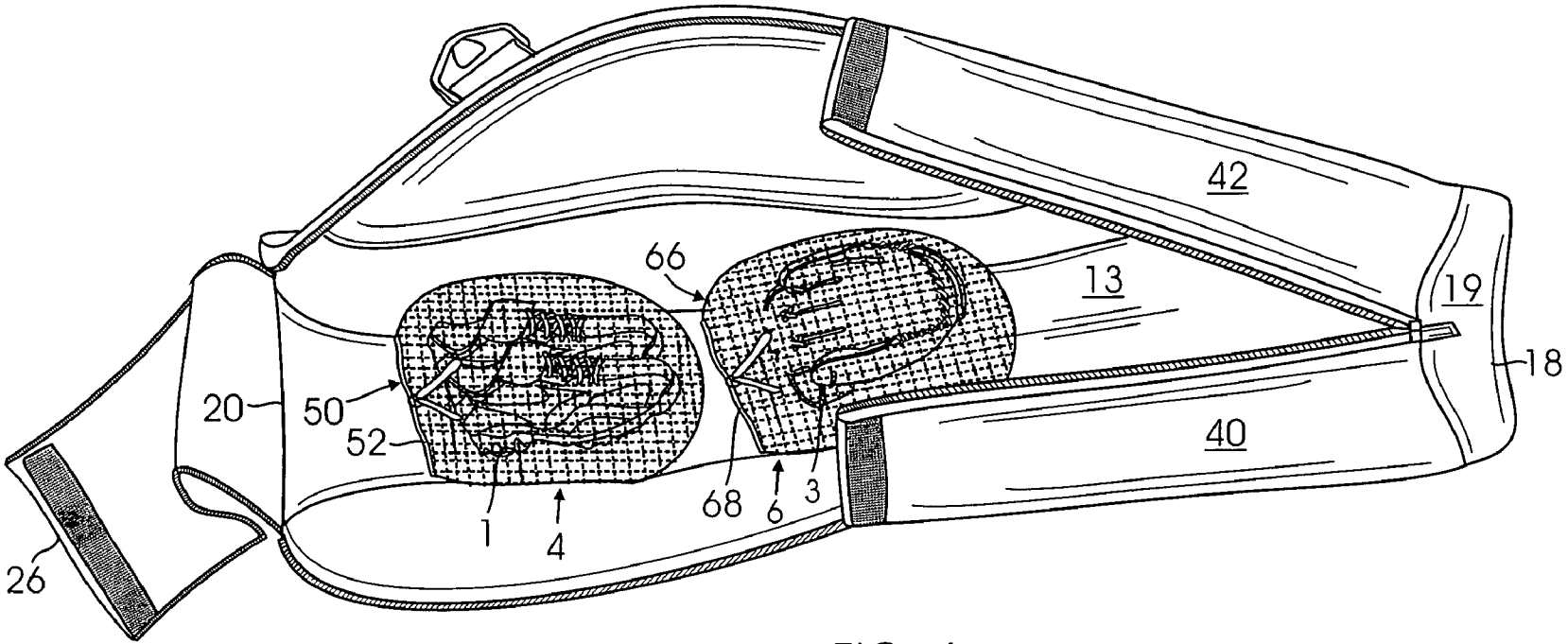
FIG. 4 is an interior top plan view of the preferred embodiment of the present invention bag with the addition of two mesh pouches, wherein the bag is unzippered and the two mesh pouches affixed on the bottom are illustrated to respectively contain a baseball glove and a pair of shoes.

Referring to FIG. 4, there is illustrated an application of the present invention addition of nylon mesh pouches within a bag, wherein a pair of shoes 1 is placed inside of the first pouch 4 with the top opening 50 securely closed through tightening the drawstrings 54 and 55, and a baseball mitt 3 is securely placed inside of the second pouch 6, wherein the opening 66 is also closed. The application illustrates that different types of items can be separately placed in each pouch. Therefore, the present invention addition of internal pouches enables placement of the items in a convenient and organized fashion and also increases the storage capacity of the bag.

Figure 5:
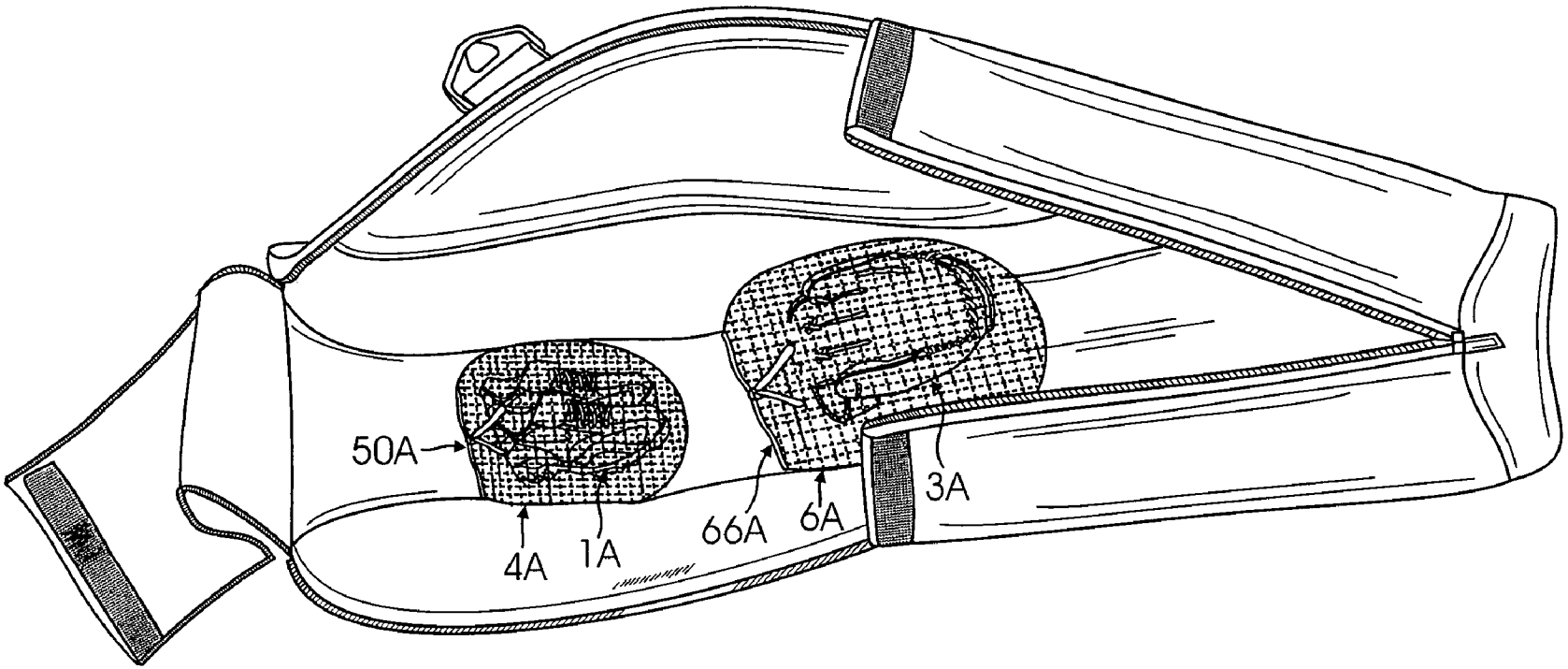
FIG. 5 is an interior top plan view of the preferred embodiment of the present invention bag with the addition of two mesh of different sizes pouches, wherein the bag is unzippered and the two mesh pouches affixed on the bottom are illustrated to respectively contain a baseball glove and a smaller pair of shoes.

While the two pouches illustrated in FIG. 4 are approximately the same size, it will be appreciated that it is within the spirit and scope of the present invention for the two pouches to be of different sizes as illustrated in FIG. 5. Referring to FIG. 5, there is illustrated an application of the present invention addition of nylon mesh pouches within a bag, wherein a pair of small shoes 1A is placed inside of the first small pouch 4A with the top opening 50A securely closed through tightening the drawstrings, and a baseball mitt 3A is securely placed inside of the second larger pouch 6A, wherein the opening 66A is also closed. The application illustrates that different types of items can be separately placed in each pouch and each pouch can be of different sizes. Therefore, the present invention addition of internal pouches enables placement of the items in a convenient and organized fashion and also increases the storage capacity of the bag.

It will be appreciated that it is within the spirit and scope of the present invention addition of interior pouches into bags that the first and second pouch 4 and 6 do not have to be identical and do not have to have the same orientation. The number of the interior pouches is also not limited to two as illustrated in FIGS. 2-5. It is within the spirit and scope of the present invention to have at least one pouch. Furthermore, the at least one pouch is not limited to being located on the bottom interior side of the bag. For example, the at least one pouch 8 can be placed on an interior side of the front or back side of the bag, which is illustrated in FIG. 6, as another preferred embodiment of the present invention.

Figure 6:
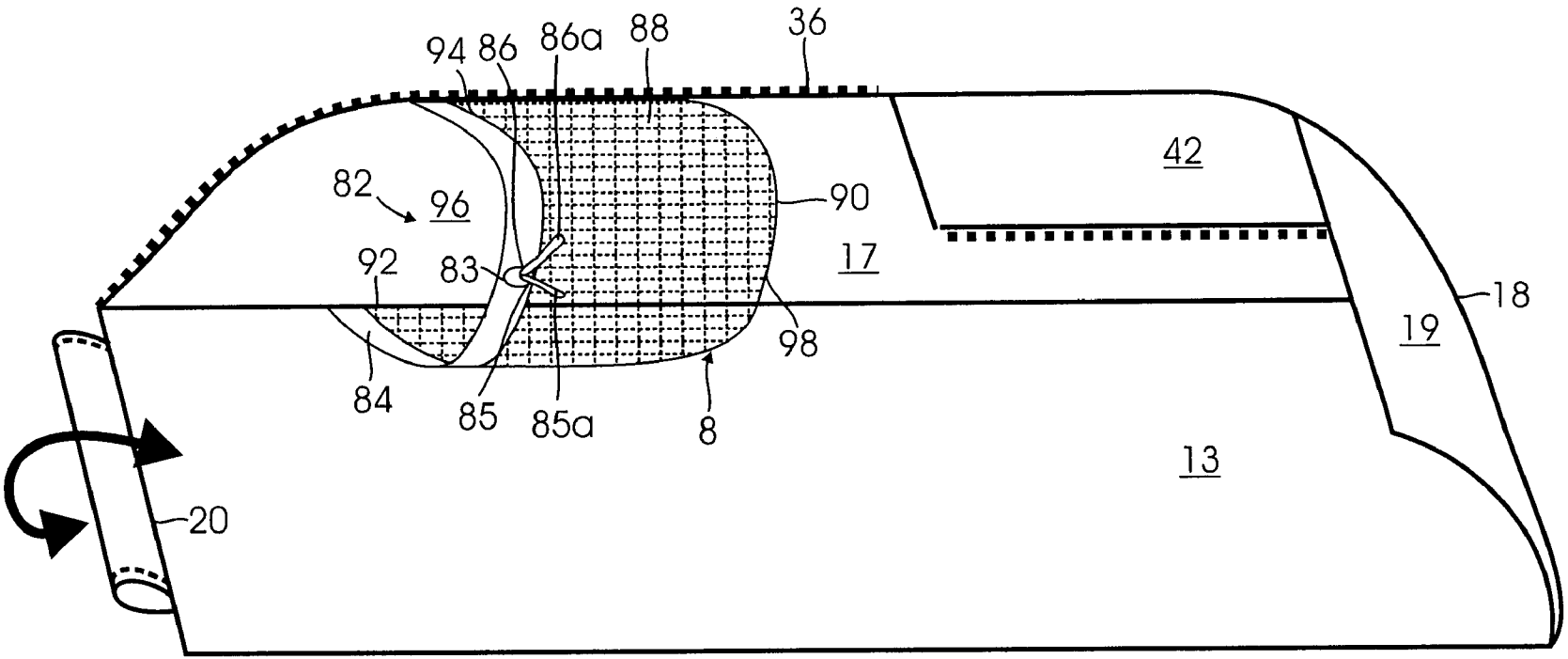
FIG. 6 is a cutaway view of an another preferred embodiment of the present invention bag with the addition of at least one mesh pouch onto an inner side of the bag back side, wherein the front side of the bag is removed so that the addition of the mesh pouch is illustrated in detail.
Figure 7:
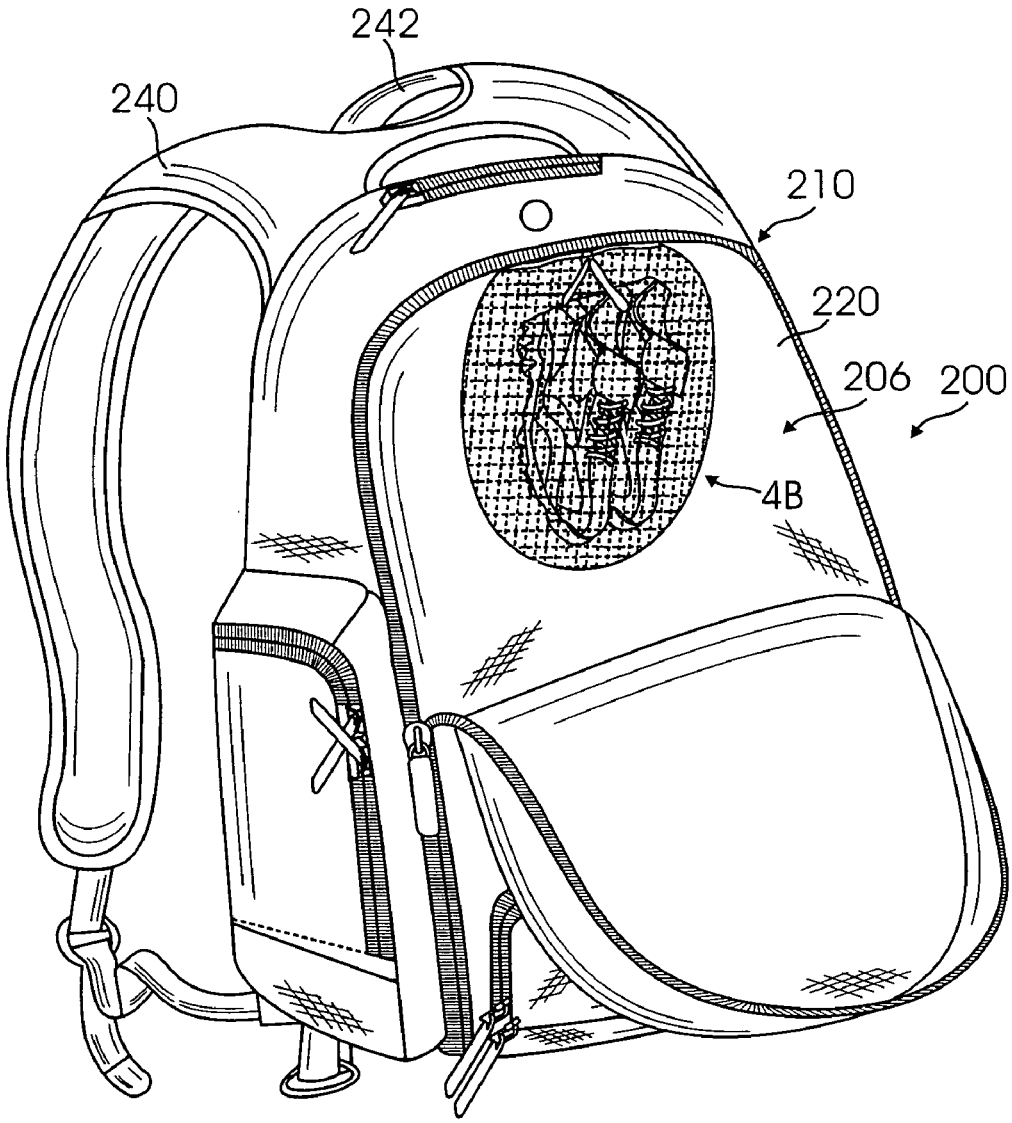
FIG. 7 is a perspective view of a backpack with at least one mesh pouch secured onto an interior surface of the backpack, with items retained in the mesh pouch.

Referring to FIG. 6 which is a cutaway view wherein the front side 14 of the bag body is removed along with the top front panel 40, the at least one pouch 8 is illustrated to comprise a body 88 having an elastic top opening 82 which is towards the left end 20 of the bag, an enclosed bottom side 90, and a back side 98. Using the orientation of the opening 82 towards the left end 20 as a reference, the pouch body 88 at its left side end 92 is affixed through stitches to a bottom side edge of an interior side 17 of the bag back side 16. Similarly, a right side end 94 of the pouch body 88 is affixed to the interior side 17 of the bag back side. It will be appreciated that the bottom side 90 of the pouch body 88 is also connected to the interior side 17 of the bag back side 16. Therefore, the connection of the right, left and bottom sides of the pouch body 88 to the interior side 17 of the bag back side 16 defines the pouch body back side 98, which is a part of the interior side 17. The connection also defines the elastic top opening 82 of the pouch 8 through which personal belongings can be placed into the at lease one pouch 8.

The top elastic opening 82 is comprised of a top hem 84 which further comprises a bottom side and top side drawstring 85 and 86. It will be appreciated that a second end of the bottom draw string 85 is affixed to the interior side 17 of the bag through affixation of the bottom side end 90 of the pouch body 88 to the interior side 17 of the bag, while a first end 85*a* of the string 85 is placed through an opening 83 at a middle of the hem 84. Similarly, a second end of the top drawstring 86 is affixed to the bag back side 16 through affixation of the right side end 94 of the pouch body 88 to the top of the back side 16 of the bag, and a first end 86*a* is also placed throughout the opening 83 of the hem 84. Therefore, the top elastic opening 82 of the at least one pouch 8 can be closed through tightening the first ends 85*a* and 86*a* of the respective bottom and top drawstrings 85 and 86 to gather the elastic hem 84 together so that personal belongings placed inside of the pouch can be securely saved. It will be appreciated that it is within the spirit and scope of the present invention for the opening 83 to be located at a location which is not at the middle of the top hem 84. In addition, the drawstrings 85 and 86 can be replaced by a single string wherein a middle of the single string is placed through the opening 83 of the hem 84. Instead of the drawstrings, any type of fastener means can be utilized as long as the fastener means can securely close the top opening 82 of the pouch. Furthermore, the at least one pouch 8 is not limited to opening towards the left end 20 of the bag and can open in any direction.

It will be appreciated that the present invention pouches can be made of any kind of flexible material as long as they can flexibly retain objects.

Further, it will be appreciated that while the bag 100 has been described in detail, the present invention nylon mesh pouches can be incorporated into any sports bag which has exterior surfaces defining an interior chamber. One such alternative embodiment is a backpack 200 which contains traditional components such as a body 210 carried by shoulder straps 240 and 242 and having at least one interior chamber 206 having at least one interior wall 220. The present invention nylon mesh bag 4B which has the same design as the nylon mesh bags described in FIGS. 2 through 6 is affixed onto the at least one interior wall 220 in the same manner as previously described and has an opening closed by drawstrings in the same manner as previously described so that objects such as shoes can be retained therein. It will be appreciated that it is within the spirit and scope of the present invention for the backpack to contain several such pouches at different locations on different interior sidewalls of the backpack and the pouches can be of different sizes.

Figure 8:
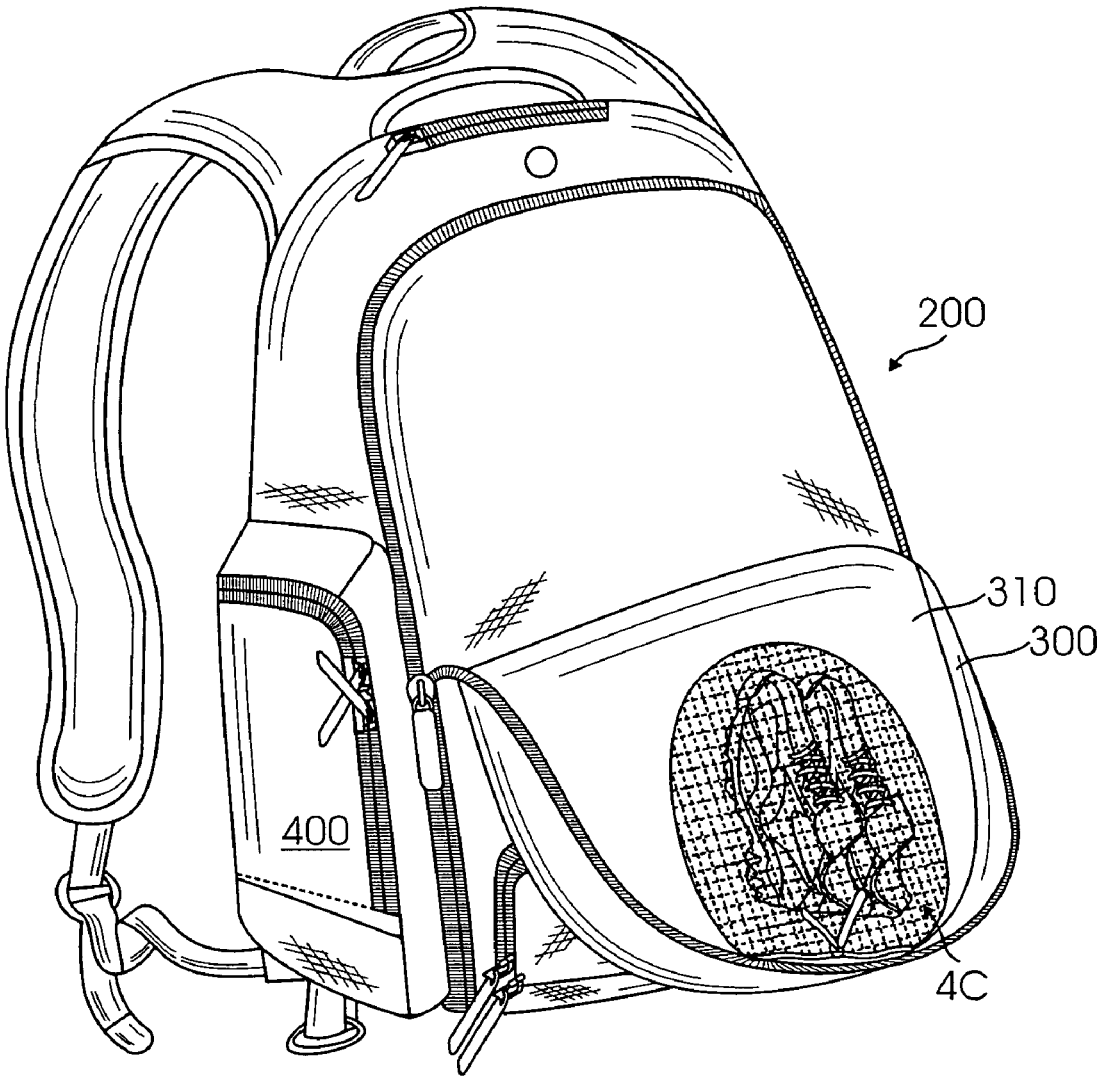
FIG. 8 is a perspective view of a backpack with a side pouch of a backpack folded down to expose at least one mesh pouch secured onto an interior surface of the side pouch of the backpack with items retained in the mesh pouch.

In addition, as illustrated in FIG. 8 the backpack can contain a side compartment 300 as is conventionally found in backpacks and the present invention mesh pouch 4C can be affixed onto a sidewall 310 of the side compartment 300. While illustrated in side compartment 300, it will be appreciated that the mesh pouch can be incorporated into a sidewall of other side compartments such as 400 illustrated in FIG. 8. The present invention nylon mesh bag 4C which has the same design as the nylon mesh bags described in FIGS. 2 through 6 is affixed onto the at least one interior wall 310 in the same manner as previously described and has an opening closed by drawstrings in the same manner as previously described so that objects such as shoes can be retained therein. It will be appreciated that it is within the spirit and scope of the present invention for the backpack to contain several such pouches at different locations on different side compartments of the backpack and the pouches can be of different sizes.

Defined in detail, the present invention is a bag comprising: (a) the bag including a bag body having a top, a bottom, a front side, a back side, a left end and a right end all defining an interior chamber, the bottom having an interior surface within the chamber; and (b) at least one pouch being affixed onto the interior surface of the bottom of the bag body, the pouch having a body having an elastic top opening, a left and right side end, an enclosed bottom side, and a back side, the pouch body at its left and right side end is affixed through stitches to a respective front and back side edge of the interior of the bottom of the bag, the pouch bottom side is also connected to the interior side of the bag bottom, the top elastic opening having a top hem which includes a front side and back side drawstring, a second end of the front side drawstring is affixed to the front edge of the interior side of the bag bottom, a first end of the front draw string is placed throughout an opening at a location of the hem, a second end of the back drawstring is affixed to the back edge of the interior side of the bag bottom side, a first end of the back draw string is placed throughout the opening of the hem, the second pouch is structurally identical to the first pouch which is placed.

Defined more broadly, the present invention is a bag comprising: (a) the bag including a bag body having a top, a bottom, a front side, a back side, a left end and a right end all defining an interior chamber, the bottom having an interior surface within the chamber; and (b) at least one pouch being affixed onto an interior side of the bottom of the bag body, the at least one pouch comprising a body having an elastic top opening which is towards an end of the bag, a first and second side end, an enclosed bottom side, and a back side, the pouch body at its first and second side end is affixed through stitches to a respective front and back side edge of the interior side of the bottom of the bag, the pouch bottom side is also connected to the interior side of the bag bottom, the top elastic opening has a top hem which includes a first drawstring to enable the pouch to be closed.

Defined even more broadly, the present invention is a bag comprising: (a) a bag including a bag body comprising a top and bottom side, a front and back side, a left and right side defining an interior chamber; (b) at least one pouch being affixed onto the interior of the bag body, the at least one pouch comprising a body including an elastic opening containing a fastener means which can be used to close the opening of the pouch; (c) whereby the elastic opening of the at least one pouch can be closed from operating the fastener means to close the elastic opening so that items placed inside of the pouch can be securely saved.

Defined most broadly, the present invention is a bag including comprising: (a) the bag having exterior walls which define an interior chamber and at least one interior sidewall; (b) at least one pouch being affixed onto the interior sidewall, the at least one pouch comprising a body including an elastic opening with a fastener means which can be used to close the opening of the pouch; and (c) whereby the elastic opening of the at least one pouch can be closed by operating the fastener means so that items placed inside of the pouch can be securely carried.

Defined alternatively in detail, the present invention is a backpack comprising: (a) the backpack including a backpack body defining an interior chamber having at least one interior sidewall; and (b) at least one pouch being affixed onto the interior sidewall of the backpack, the pouch having a body having an elastic top opening, said top elastic opening having a top hem which includes a front side and back side drawstring to close the opening.

Defined alternatively more broadly, the present invention is a backpack comprising: (a) the backpack having exterior walls which define an interior chamber and at least one interior sidewall; and (b) at least one pouch being affixed onto the interior sidewall, said at least one pouch comprising a body including an elastic opening with a fastener means which can be used to close the opening of the pouch; (c) whereby said elastic opening of said at least one pouch can be closed by operating said fastener means so that items placed inside of the pouch can be securely carried.

Defined as a variation on the alternative embodiment, the present invention is a backpack comprising: (a) the backpack including a backpack body supporting at least one exterior compartment which has at least one interior sidewall; and (b) at least one pouch being affixed onto the interior sidewall of the exterior compartment of the backpack, the pouch having a body having an elastic top opening, said top elastic opening having a top hem which includes a front side and back side drawstring to close the opening.

The variation defined more broadly is a backpack comprising: (a) the backpack including a backpack body supporting at least one exterior compartment which has at least one interior sidewall; and (b) at least one pouch being affixed onto the interior sidewall, said at least one pouch comprising a body including an elastic opening with a fastener means which can be used to close the opening of the pouch; (c) whereby said elastic opening of said at least one pouch can be closed by operating said fastener means so that items placed inside of the pouch can be securely carried.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A bag comprising:

a. the bag including a bag body having a top side, a bottom, a front side, a back side, a left end and a right end all defining an interior chamber, the bottom having an interior surface within the chamber;

b. at least two pouches being affixed onto the interior surface of the bottom of the bag body, the first pouch having a body having an elastic top opening, a left and right side end, an enclosed bottom side, and a back side, said pouch body at its left and right side end is affixed through stitches to a respective front and back side edge of the interior of the bottom of the bag, said pouch bottom side is also connected to the interior side of the bag bottom, said top elastic opening having a top hem which includes a front side drawstring and a back side drawstring, a second end of said front side drawstring is affixed to the front edge of the interior side of the bag bottom, a first end of the front draw string is placed throughout an opening at a location of the hem, a second end of said back drawstring is affixed to the back edge of the interior side of the bag bottom side, a first end of said back draw string is placed throughout the opening of the hem, the second pouch is structurally identical to the first pouch and which is placed in series with the first pouch;

c. both of the at least two pouches are accessible when the bag is at least partially opened without requiring the interior surface of the bag containing the at least two pouches to be removed or extended out of the bag;

d. each of the pouches are made of nylon mesh which are flexible enough to retain large objects within each respective nylon mesh pouch;

e. the top side of the bag body is comprised of a top elongated rectangular panel and a pair of two short rectangular front and back panels, the top elongated panel has a movable end capable of being swung backwards and forwards with respect to the left end of the bag, the top elongated panel can be removably affixed to the left end of the bag and this removably affixed portion of the top elongated panel is remote from an upper fixed end of the top elongated panel which is affixed to a top portion of the topside of the bag, the top elongated, panel movable end is free to move in a forward and backward swinging movement;

f. the top elongated rectangular panel is further comprised of a front elongated edge which is affixed to one set of a front side zipper, another set of the zipper is affixed to a majority of the top edge of the front side of the bag wherein the zipper set starts at a position close to the left end of the bag and extends to a position at the top edge of the bag front side;

g. the zipper having two sets is zippered where a zipper handle is placed at a position on top of the front side of the bag; similarly, a back elongated edge of the top panel is affixed to one set of a back side zipper and another set of the back side zipper is affixed to a majority of the top edge of the back side of the bag;

h. the right end of the top panel is used to cover part of the front and back panel;

the two short rectangular front and back panels are symmetrically affixed to the right half of the top of the bag body, the rectangular front panel at its front elongated edge is affixed to the top edge of the front side of the bag at its right edge is connected to a top of the right end side of the bag and at its back elongated edge is affixed to a set of a middle zipper, the left end of the front panel is a free end but is attached with a hook and loop fastener means, the rectangular back panel at its back elongated edge is affixed to the top edge of the back side of the bag, at its right edge is affixed to a top of the right end side of the bag and at its front elongated edge is affixed to the middle zipper, the left end of the front panel is also free but is attached with a hook and loop fastener means;

i. the respective hook and loop fastener means are affixed on a back side of the top panel close to the movable end, therefore the top panel can be securely closed after connection with respective fastener means at the right end of the top panel through the fastener means at a respective left end of the respective front and back panel when the middle zipper is closed;

j. when the top panel is swung backwards, and the middle zipper is unzipped to separate the top front and back panels, the internal structure of the bag is visible illustrating the at least one pouch so that through the unique front and back flat panels, access can be gained to the entire interior of the bag; and k. the structure of the top elongated rectangular panel and two short rectangular panels permit access to the complete interior of the bag while the bag is lying on the ground and is not required to be suspended from any structure whatsoever.

2. The bag in accordance with claim 1 wherein the at least two pouches are at spaced apart locations within the interior chamber of the bag.

3. A bag comprising:

a. the bag including a bag body having a top, a bottom, a front side, a back side, a left end and a right end all defining an interior chamber, the bottom having an interior surface within the chamber;

b. at least one pouch being affixed onto an interior side of the bottom of the bag body, said at least one pouch comprising a body having an elastic top opening which is towards an end of the bag, a first and second side end, an enclosed bottom side, and a back side, said pouch body at its first and second side end is affixed through stitches to a respective front and back side edge of the interior side of the bottom of the bag, said pouch bottom side is also connected to the interior side of the bag bottom, said top elastic opening has a top hem which includes a first drawstring to enable the pouch to be closed; and c. the at least one pouch is accessible when the bag is at least partially opened without requiring the interior side of the bag containing the pouch to be removed or extended out of the bag d. the at least one pouch is made of nylon mesh which is flexible enough to retain large objects within each respective nylon mesh pouch:

e. the top side of the bag body is comprised of a top elongated a rectangular panel and a pair of two short rectangular front and back panels, the top elongated panel has a movable end capable of being swung backwards and forwards with respect to the left end of the bag, the top elongated panel can be removably affixed to the left end of the bag and this removably affixed portion of the top elongated panel is remote from an upper fixed end of the top elongated panel which is affixed to a top portion of the top side of the bag, the top elongated panel movable end is free to move in a forward and backward swinging movement;

f. the top elongated rectangular panel is further comprised of a front elongated edge which is affixed to one set of a front side zipper, another set of the zipper is affixed to a majority of the top edge of the front side of the bag wherein the zipper set starts at a position close to the left end of the bag and extends to a position at the top edge of the bag front side;

g. the zipper having two sets is zippered where a zipper handle is placed at a position on top of the front side of the bag; similarly, a back elongated edge of the top panel is affixed to one set of a back side zipper and another set of the back side zipper is affixed to a majority of the top edge of the back side of the bag;

h. the right end of the top panel is used to cover part of the front and back panel; the two short rectangular front and back panels are symmetrically affixed to the right half of the top of the bag body, the rectangular front panel at its front elongated edge is affixed to the top edge of the front side of the bag at its right edge is connected to a top of the right end side of the bag and at its back elongated edge is affixed to a set of a middle zipper, the left end of the front panel is a free end but is attached with a hook and loop fastener means, the rectangular back panel at its back elongated edge is affixed to the top edge of the back side of the bag, at its right edge is affixed to a top of the right end side of the bag and at its front elongated edge is affixed to the middle zipper, the left end of the back panel is also free but is attached with a hook and loop fastener means;

i. the respective hook and loop fastener means are affixed on a back side of the top panel close to the movable end, therefore the top panel can be securely closed after connection with respective fastener means at the right end of the top panel through the fastener means at a respective left end of the respective front and back panel when the middle zipper is closed;

j. when the top panel is swung backwards, and the middle zipper is unzipped to separate the top front and back panels, the internal structure of the bag is visible illustrating first and second identical pouches so that through the unique front and back flat panels, access can be gained to the entire interior of the bag; and k. the structure of the top elongated rectangular panel and two short rectangular panels permit access to the complete interior of the bag while the bag is lying on the ground and is not required to be suspended from any structure whatsoever.

4. The bag in accordance with claim 3 wherein the at least pouch is two identical pouches at spaced apart locations within the interior chamber of the bag and affixed in the same way as the at least one pouch.

* * * * *